US006901922B2

(12) United States Patent
Forti et al.

(10) Patent No.: US 6,901,922 B2
(45) Date of Patent: Jun. 7, 2005

(54) AIR PROPELLED WATER WAD LAUNCHER

(76) Inventors: William M. Forti, 112 N. Harvard #229, Claremont, CA (US) 91711; William B. Forti, 112 N. Harvard #229, Claremont, CA (US) 91711; David M. Turchik, 916 Haley Talbert Dr., Corona, CA (US) 92881

( * ) Notice: Subject to any disclaimer, the term of this patent is extended or adjusted under 35 U.S.C. 154(b) by 0 days.

(21) Appl. No.: 10/759,848

(22) Filed: Jan. 15, 2004

(65) Prior Publication Data

US 2004/0200465 A1 Oct. 14, 2004

Related U.S. Application Data

(60) Provisional application No. 60/440,664, filed on Jan. 15, 2003.

(51) Int. Cl.[7] ..... F41B 1/00
(52) U.S. Cl. ..... 124/62

(58) Field of Search ..... 124/62

(56) References Cited

U.S. PATENT DOCUMENTS 2,679,838 A * 6/1954 Thompson ..... 124/62
3,137,287 A * 6/1964 De Arbun ..... 124/62
3,685,828 A * 8/1972 Getgey et al. ..... 273/356
4,010,902 A * 3/1977 Speyer ..... 239/428.5

* cited by examiner

*Primary Examiner*—Michael Carone
*Assistant Examiner*—Troy Chambers
(74) *Attorney, Agent, or Firm*—Rutan & Tucker

(57) ABSTRACT

A blowgun has a movable mouthpiece coupled to a barrel, wherein a soft, and preferably fluid-soaked projectile is inserted into the barrel through the mouthpiece via a continuous channel that is formed by the mouthpiece and the barrel. After loading of the projectile, the channel is closed by moving the mouthpiece relative to the barrel.

14 Claims, 1 Drawing Sheet

AIR PROPELLED WATER WAD LAUNCHER

This application claims the benefit of our now abandoned U.S. provisional patent application with the Ser. No. 60/440,664, which was filed Jan. 15, 2003, and which is incorporated by reference herein.

FIELD OF THE INVENTION

The field of the invention is toy blowguns (U.S. Class 124/62).

BACKGROUND OF THE INVENTION

Air propelled toys enjoy increasing popularity, and particularly popular air propelled toys include blow guns, air propelled rockets, and paintball guns. Remarkably, while automation and launch power of most of such toys has considerably increased, devices and configurations for air propelled launchers using only the breath of a player (i.e., blowguns) remained relatively simple.

A general depiction of a known blowgun is shown in U.S. Des. Pat. No. 358,444 to Bybee and a similar blowgun is further described in U.S. Pat. No. 4,419,978 to Loftus. In one improvement of a blowgun as described in U.S. Pat. No. 6,588,413 to Nagasue, the mouthpiece is configured such that the sights mounted on the barrel of the gun are visible while the mouthpiece of the blowgun is in the user's mouth. Here, the mouthpiece is angled and mounted to the barrel, such that the mouthpiece must either be taken off the barrel, or that a latch must be opened to insert the arrow. While such an improvement significantly facilitates accurate launching, the angled mouthpiece tends to prevent fast acceleration of the projectile as the air is forced into a turbulent path before hitting the projectile.

In other known improvements, the number of rounds that can be fired from a blowgun is increased, and various configurations for such improvements have been described. For example, Arbun (U.S. Pat. No. 3,137,287) and Hoverath et al. (U.S. Pat. No. 3,388,696) described configurations in which multiple rounds are advanced from a magazine that is attached to the barrel of the blowgun. Alternatively, and especially where the rounds are generally spherical objects (e.g., peas, or round pellets), multiple rounds can be fed from a separate tube through a manually operated adapter element as shown in U.S. Pat. No. 2,888,003 to Swanson, or automatically in rapid succession under the force of gravity as described in U.S. Pat. No. 2,427,490 to Berrayarza et al. In still further known configurations, automatic gravity-driven reloading from a movable hopper allows firing of successive rounds of peas or other objects as described in U.S. Pat. No. 1,152,447 to Sproull.

However, despite the relatively simple configurations of most, if not all of the known blowguns, the feeding mechanism often tends to jam due to incomplete automatic insertion of the next round. Moreover, where the projectile is relatively soft or is soaked with a fluid, most, if not all of the known blowguns would fail to reliably reload the blowgun. Therefore, although there are numerous configurations and methods known in the art for improving one or more aspects of use in a blow gun, all or almost all or then suffer from several disadvantages. Thus, there is still a need to provide improved blowguns, especially where soft and/or fluid-soaked projectiles are propelled from the blowgun.

SUMMARY OF THE INVENTION

The present invention is directed to a blowgun that is operated using a user's breath in which a movable mouthpiece is coupled to the barrel, and wherein the mouthpiece and the barrel have a position relative to each other in which they provide a continuous channel for (preferably manual) reloading.

Consequently, in one aspect of the inventive subject matter, a blowgun includes a barrel having a proximal portion with a discharge opening and a distal portion with a first opening and a second opening. A mouthpiece is movably coupled to the distal portion of that barrel, wherein the mouthpiece is movable (preferably slidably) between a first position and a second position, the mouthpiece further comprising a load opening. In contemplated blowguns, the mouthpiece has a first portion that is configured to receive a blast of air from a user's mouth and a second portion that provides at least part of the blast to the second opening of the distal portion, wherein the load opening of the mouthpiece and the first opening of the distal portion form a continuous path that allows insertion of a projectile therethrough when the mouthpiece is in the first position, and wherein the continuous path is disrupted when the mouthpiece is in the second position. With respect to the continuous path, it is generally preferred that the path is substantially straight and sealed when the mouthpiece is in the second position.

It is further preferred that such blowguns further comprise a tubular container that is coupled to the barrel, wherein the container is configured to retain the projectile. Additionally, or alternatively, the blowgun may further comprise a retaining element that is coupled to the barrel, wherein the retaining element is configured to retain a pushrod (optionally filled with a fluid) that is configured to allow retrieving of the projectile from the tubular container. Where it is desirable that the projectiles are soft, it is particularly preferred that the projectiles retain a fluid on the outside of the projectile material.

Thus, and viewed from another perspective, suitable blowguns will include a barrel and a mouthpiece movably coupled to the barrel, wherein a projectile is manually loaded into the barrel through the mouthpiece when the barrel is in a first position relative to the mouthpiece, and wherein the projectile is propelled from the barrel by a blast from a user's mouth through the mouthpiece when the barrel is in a second position relative to the mouthpiece. With respect to additional components, configurations, and uses, the same considerations as provided above apply.

Various objects, features, aspects and advantages of the present invention will become more apparent from the following detailed description of preferred embodiments of the invention along with the accompanying drawing.

DETAILED DESCRIPTION

Figure 1:
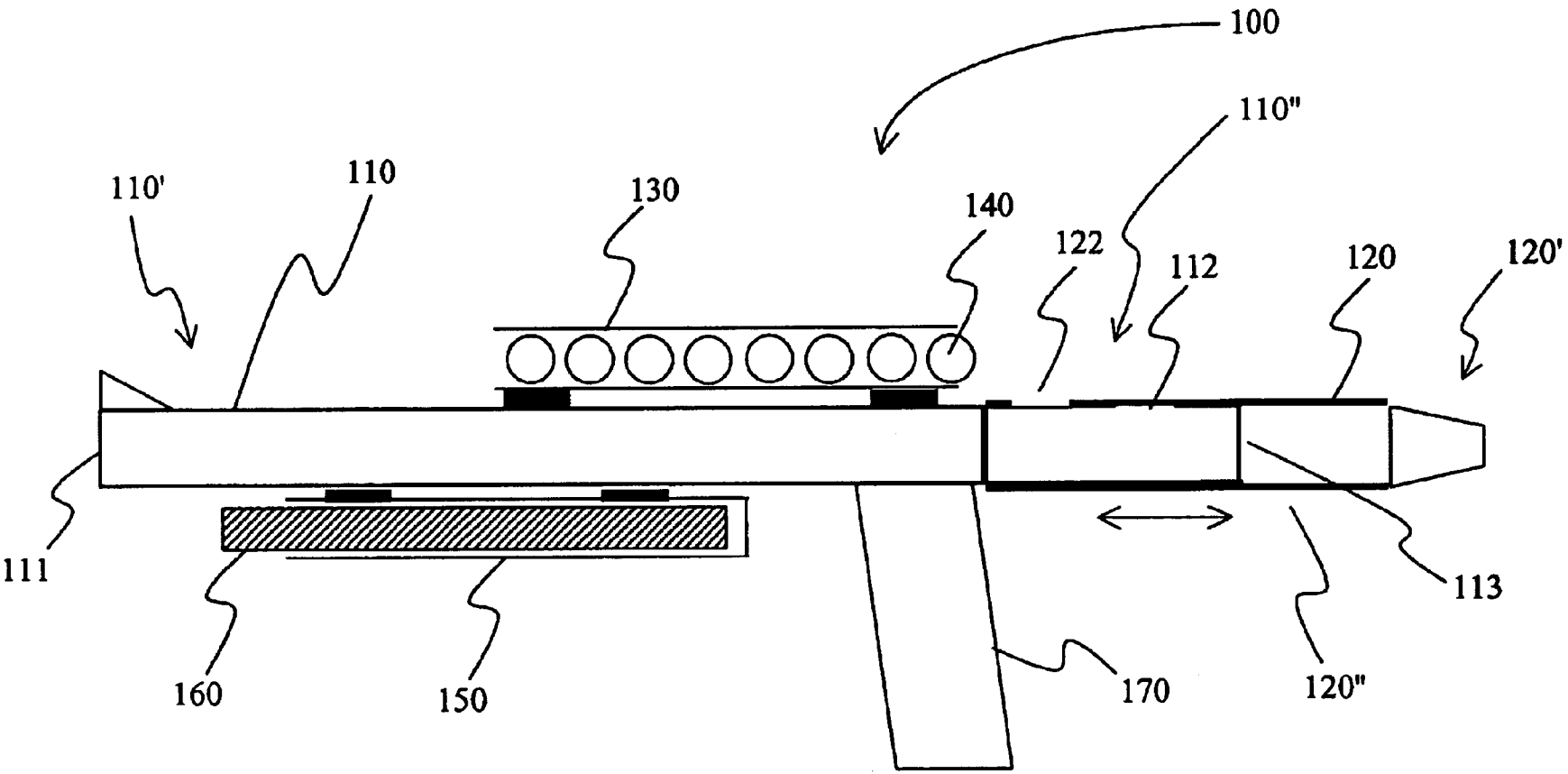
FIG. 1 is a schematic drawing of a blowgun according to the inventive subject matter.

The inventors generally contemplate a toy in which fluid soaked soft projectiles are shot from a barrel by air blown through a mouthpiece, in which the fluid and the projectiles are carried on the toy, and in which the projectiles are loaded into the barrel through a continuous channel that is formed by a portion of the movable mouthpiece and a portion of the barrel.

One exemplary blowgun is depicted in FIG. 1 in which blowgun 100 has a barrel 110 that is slidably coupled to a mouthpiece 120 such that the mouthpiece can move coaxial relative to the barrel (see double arrow). The barrel 110 has a proximal portion 110' with a discharge opening 111 that corresponds to lumen of barrel, and a distal portion 110" with a circular first opening 112 and a second opening 113 that corresponds to lumen of barrel. The mouthpiece 120 has one end 120' that is configured to receive a blast of air from a user's mouth, and further has a circular load opening 122. The blast of air is then transmitted through the second portion 120" of the mouthpiece into the barrel.

In FIG. 1, the mouthpiece and the barrel are positioned relative to each other such that a portion of the mouthpiece covers, and more typically substantially seals the first opening 112 of the barrel 110. The term "substantially seals" as used herein means that less than 10% of air blown into portion 120' will escape through first opening 112 when the first opening of the barrel and the load opening of the mouthpiece do not overlap. When the mouthpiece 120 of FIG. 1 is moved in a sliding motion away from the barrel 110, the first opening 112 and the load opening 122 will at least partially, and more preferably entirely coincide at some point to form a straight continuous path (not shown) through which projectile 140 can be inserted.

Once the projectile 140 is loaded into the barrel 110 through openings 112 and 122, the mouthpiece is slid into a position such that the openings 112 and 122 do no more overlap. Thus, air blown through the barrel 110 via mouthpiece 120 will propel projectile 140 from the barrel. It should be especially noted that the mouthpiece and the barrel are in coaxial relationship with each other to maximize airflow and air momentum. To assist aiming and/or holding of the barrel, handle 170 is added to the barrel. In a particularly preferred aspect, a plurality of projectiles is stored in a tubular receptacle 130 that is mounted onto the barrel. To retrieve one or more of the projectiles, push rod 160 (which may be stored in holder 150) is inserted into the receptacle 130. Additionally, push rod 160 may contain water or any other fluid that is employed to soak the projectile 140 while the projectile is in the receptacle, the user's hand, or in the barrel.

Particularly preferred barrels are produced from synthetic polymers (e.g., polyethylene, polypropylene, poly(vinyl chloride), polycarbonate, etc.), metal, natural materials, or any reasonable combination thereof. Depending on the particular materials and configuration of the blowgun, it should be appreciated that the barrel and other elements of the blowgun may be formed integrally using molding or other forming technologies.

With respect to the dimensions of suitable barrels, it is generally contemplated that the length and/or diameter of the barrel may vary considerably. However, it should be recognized that as contemplated blowguns are intended for recreational use, typical lengths are generally less than 6 feet and typical diameters are generally less than 1 inch. For example, where the toy is predominantly used in an indoor setting, the length of the barrel may be between 10" and 20". On the other hand, and especially where increased precision is desirable, suitable barrels may have a length of between about 15" to 45", and even longer. Similarly, suitable diameters will typically depend on the size of the projectile, and/or source of air provided to the toy. For example, where the projectile is a soft foam pellet or pom-pom (which may be water-soaked), typical diameters may be between about ¼" to about ¾". On the other hand, in less preferred aspects of the inventive subject matter, where the projectile is propelled by a user via an air supply container (e.g., from a vessel containing compressed air or other gas), contemplated diameters may be between about ½" to about 1.5", and even larger.

Consequently, it should be recognized that the dimensions of the mouthpiece would depend at least in part on the dimensions of the barrel. Typically, the mouthpiece will be dimensioned such that at least one end of the mouthpiece engages movably, and most preferably slidably or rotatably with one end of the barrel. Moreover, it is generally contemplated that the length of the mouthpiece will generally be less than the length of the barrel. Therefore, suitable lengths for the mouthpiece will be in the range of between about 3" to about 8". In further alternative aspects, it should be recognized that the mouthpiece may be movably engaged with the barrel in various modes other than slidable or rotatable, and all manners of movable coupling are considered suitable for use herein so long as the barrel and the mouthpiece have a first position relative to each other that allows insertion of the projectile through an opening in at least one of the barrel and the mouthpiece, and a second position that closes the opening. With respect to the materials from which the mouthpiece may be manufactured, it is contemplated that the same considerations as for the barrel apply.

Depending on the particular size and shape of the projectile, it is further contemplated that the load opening in the mouthpiece and the first opening may vary considerably. However, and especially where the projectile has a generally spherical shape, contemplated load openings and first openings are round or square. Alternatively, where the projectile has an oblong shape, suitable load and first openings may be rectangular or oval. Thus, in particularly preferred aspects of the inventive subject matter, the path through which the projectile is inserted into the barrel is straight and may be angled or vertical relative to the longitudinal axis of the barrel. However, and particularly where the first opening and the second opening in the barrel are identical (i.e., where the barrel has no separate opening that coincides with the load opening), it should be recognized that the path through which the projectile is inserted into the barrel is curved (e.g., projectile is inserted through load opening and enters the barrel though the second opening along a curved path). Further preferred mouthpieces are generally co-axial with barrel to avoid impeded flow of air from the mouthpiece to the barrel.

Alternatively, in another preferred aspect of the inventive subject matter, the mouthpiece may be permanently or removably coupled to the barrel, and an additional movable sleeve is disposed on the blowgun such that the sleeve in a first position covers an opening in the barrel and/or the mouthpiece, and that the sleeve reveals the opening in the barrel and/or the mouthpiece in a second position to allow a projectile to be inserted into the barrel. Furthermore, where a sleeve is employed in contemplated toys, it is especially preferred that the mouthpiece is configured to prevent the sleeve from falling off the toy. For example, suitable mouthpieces may have an outer diameter that is greater than the inner diameter of the sleeve to prevent the sleeve from moving over the mouthpiece.

In a further especially preferred aspect of the inventive subject matter, the projectile is a soft, fibrous ball-shaped textile object, and it is particularly preferred that the projectile is saturated with water or any other non-toxic fluid. Therefore, particularly suitable projectiles include water soaked pom-pom balls (e.g., polyester, wool, or other textile material), cotton balls, etc. with a diameter suitable for propulsion from the barrel. It should be especially recognized that such projectiles carry a substantial portion of the fluid on the surface rather than disposed within the projectile, which advantageously allows for repeated use of the projectile where the fluid is employed to tag a target. Consequently, the nature of the fluid may vary considerably, and it should be appreciated that all fluids, and especially non-toxic fluids may be used in conjunction with the teachings presented herein. Furthermore, suitable fluids may include colored or luminescent dyes, which may be microencapsulated to facilitate removal of the tag produced by the impact of the projectile.

In still further preferred aspects of the inventive subject matter, it is contemplated that various auxiliary articles may be coupled to the barrel, and exemplary additional articles include one or more tubular or otherwise shaped receptacles that retain a plurality of projectiles (which may or may not be fluid-soaked). Where the blowgun includes a tubular receptacle with open ends for soft projectiles, it is especially preferred that such toys also include a holder that at least temporarily retains a push rod to advance the projectile from one end of the receptacle. As with the barrel and mouthpiece, it should be recognized that the length and diameter might vary, and suitable dimensions will be dictated at least in part by the projectile, the pushrod, and/or the barrel. However, preferred lengths and diameters of the receptacle, pushrod, and/or holder will generally be adapted to functionally cooperate with the projectile, the barrel, and/or the pushrod.

Consequently, a blowgun will preferably have a barrel having a proximal portion with a discharge opening and a distal portion with a first opening and a second opening. Such blowguns will further include a mouthpiece that is movably coupled to the distal portion of the barrel, wherein the mouthpiece is movable between a first position and a second position, and further comprises a load opening, wherein the mouthpiece has a first portion that is configured to receive a blast of air from a user's mouth and a second portion that provides at least part of the blast to the second opening of the distal portion, and wherein the load opening of the mouthpiece and the first opening of the distal portion form a continuous path that allows insertion of a projectile therethrough when the mouthpiece is in the first position, and wherein the continuous path is disrupted when the mouthpiece is in the second position.

Viewed from another perspective, suitable blowguns will have a barrel and a mouthpiece movably coupled to the barrel, wherein a projectile is manually loaded into the barrel through the mouthpiece when the barrel is in a first position relative to the mouthpiece, and wherein the projectile is propelled from the barrel by a blast from a user's mouth through the mouthpiece when the barrel is in a second position relative to the mouthpiece.

Thus, specific embodiments and applications of air propelled water wad launchers have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A blowgun comprising:

a barrel having a proximal portion with a discharge opening and a distal portion with a first opening and a second opening;

a mouthpiece movably coupled to the distal portion of the barrel, wherein the mouthpiece is movable between a first position and a second position, the mouthpiece further comprising a load opening;

wherein the mouthpiece has a first portion that is configured to receive a blast of air from a user's mouth and a second portion that provides at least part of the blast to the second opening of the distal portion; and wherein the load opening of the mouthpiece and the first opening of the distal portion form a continuous path that allows insertion of a projectile therethrough when the mouthpiece is in the first position, and wherein the continuous path is disrupted when the mouthpiece is in the second position.

2. The blowgun of claim 1 further comprising a tubular container coupled to the barrel, wherein the container is configured to retain the projectile.

3. The blowgun of claim 2 further comprising a retaining element coupled to the barrel, wherein the retaining element is configured to retain a pushrod that is configured to allow retrieving of the projectile from the tubular container.

4. The blowgun of claim 3 wherein the projectile comprises a soft material that retains a fluid on an outer surface of the material.

5. The blowgun of claim 4 wherein the pushrod is configured to retain the fluid, and wherein the projectile is stored in the tubular container while soaked with at least part of the fluid.

6. The blowgun of claim 1 wherein the mouthpiece is slidably coupled to the distal portion of the barrel.

7. The blowgun of claim 1 wherein the continuous path is substantially sealed when the mouthpiece is in the second position.

8. The blowgun of claim 1 wherein the continuous path is straight.

9. The blowgun of claim 1 wherein the first and second openings of the distal portion of the barrel coincide.

10. A blowgun having a barrel and a mouthpiece movably coupled to the barrel, wherein a projectile is manually loaded into the barrel through the mouthpiece when the barrel is in a first position relative to the mouthpiece, and wherein the projectile is propelled from the barrel by a blast from a user's mouth through the mouthpiece when the barrel is in a second position relative to the mouthpiece and wherein each of the mouthpiece and the barrel have an opening, and wherein the openings from a continuous channel when the barrel is in a first position relative to the mouthpiece, and wherein the openings do not form a continuous channel when the barrel is in the second position relative to the mouthpiece.

11. The blowgun of claim 10 wherein the mouthpiece is slidably coupled to the barrel.

12. The blowgun of claim 11 wherein the projectile comprises a soft material that retains a fluid on an outer surface of the material.

13. The blowgun of claim 11 further comprising a tubular container coupled to the barrel, wherein the container is configured to retain the projectile.

14. The blowgun of claim 13 further comprising a retaining element coupled to the barrel, wherein the retaining element is configured to retain a pushrod that is configured to allow retrieving of the projectile from the tubular container.

* * * * *